United States Patent [19]

Butash

[11] Patent Number: 4,594,737

[45] Date of Patent: Jun. 17, 1986

[54] FOOTBALL HELMET FACE MASK

[76] Inventor: John D. Butash, 13644 Kingston, Oak Park, Mich. 48237

[21] Appl. No.: 694,071

[22] Filed: Jan. 23, 1985

[51] Int. Cl.[4] ..... A42B 1/08

[52] U.S. Cl. ..... 2/424; 2/410; 2/425; 2/9; 2/10

[58] Field of Search ..... 2/424, 425, 410, 9, 2/10

[56] References Cited

U.S. PATENT DOCUMENTS 3,897,598 8/1975 Bednarczuk et al. ..... 2/9

4,342,122 8/1982 Abraham et al. ..... 2/424

*Primary Examiner*—Werner H. Schroeder

*Assistant Examiner*—J. Olds

*Attorney, Agent, or Firm*—Charles W. Chandler

[57] ABSTRACT

A football helmet having a face mask formed of a wire frame with a series of beads strung along certain wires to make it difficult for an opposing player to grab the face mask. Each bead is formed such that it can be snapped on its supporting wire.

6 Claims, 4 Drawing Figures

FOOTBALL HELMET FACE MASK

BACKGROUND OF THE INVENTION

This invention is related to football helmet face masks, and more particularly to a bead that can be snapped on the individual mask frame members.

Football players usually wear a helmet having a face mask to protect their face. A conventional face mask is usually formed of a wire frame mounted in front of the user's face. A problem with such face masks is that opposing players will occasionally grab the mask and inflict serious damage to the player wearing the helmet.

One approach to resolving this problem is to mount a series of individually rotatable beads along each of the exposed wires of the frame normally grasped by the opposing player. The obvious way to mount the beads is to string them on the wire during the manufacturing process. The ends of the wire are then welded to the remainder of the frame to complete the mask. The problem with this method is the heat of the welding process tends to distort those beads adjacent the welded joints. In addition, it is impossible to replace a damaged bead once the frame has been welded together.

THE SUMMARY OF THE INVENTION

The broad purpose of the present invention is to provide a football helmet face mask having beads mounted along the individual face mask elements by being snapped onto the individual wire elements after the mask has been welded together. This provides several special advantages. For example it eliminates distortion of the beads caused by the heat of the welding process. In addition, it permits damaged beads to be quickly replaced by merely snapping a new bead in position.

Still further objects and advantages of this invention will become relatively apparent to those skilled in the art to which the invention pertains upon reference to the following detailed description.

DESCRIPTION OF THE DRAWINGS

The description refers to the accompanying drawing in which like reference characters refer to like parts throughout the several views, and in which.

DESCRIPTION OF THE PREFERRED EMBODIMENT

Figure 1:
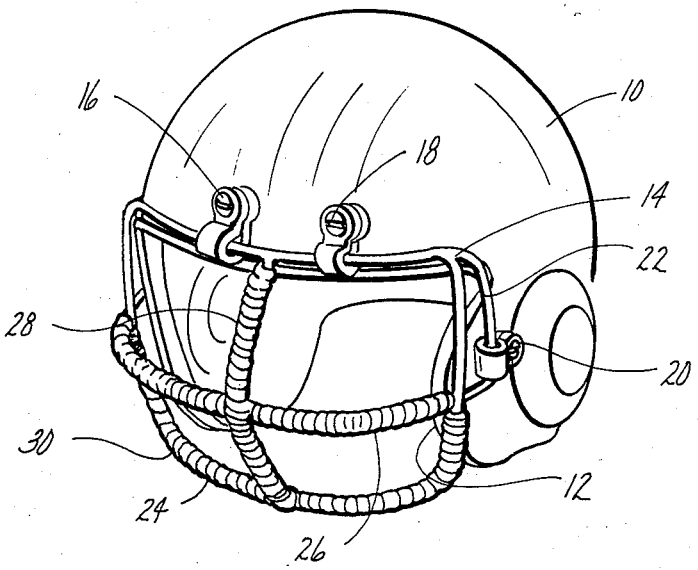
FIG. 1 is a perspective view of a face mask and football helmet illustrating the preferred embodiment of the invention.

Referring to the drawing, FIG. 1 illustrates conventional football helmet 10 which comprises a shell having a three-sided opening 12 to expose the player's face. A removable wire mask 14 is mounted over opening 12 and attached to the helmet by fastener means 16, 18 and 20. An additional fastener means, not shown is mounted on the opposite side of the helmet. Although the mask is illustrated as being formed of a series of metal wire sections, the mask could also be formed of an appropriate plastic material.

The preferred embodiment preferably has several exposed wire sections such as at 22 coated with a polyvinyl chloride coating.

The face mask has exposed horizontal sections 24 and 26, and vertical section 28.

A plurality of beads 30 are individually rotatably mounted on sections 24, 26 and 28 along their full length. It is to be noted that these sections are those that an opposing player may attempt to grasp with his hand.

Figure 2:
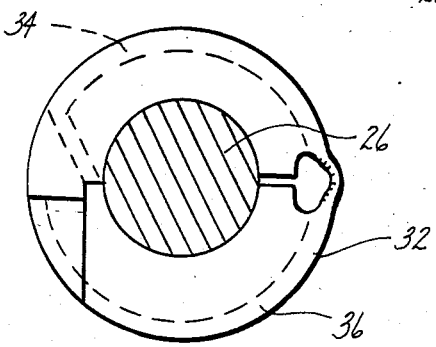
FIG. 2 is an enlarged view of a preferred bead.
Figure 3:
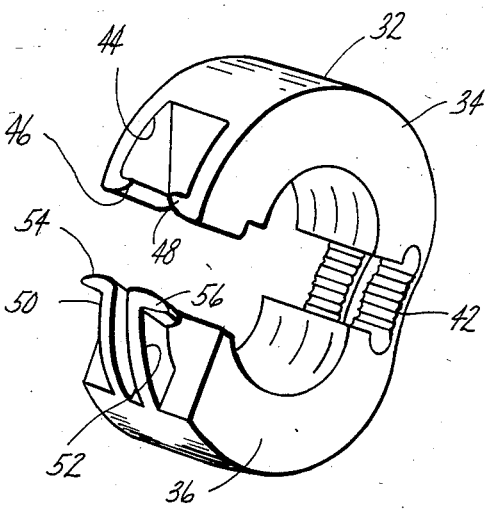
FIG. 3 is a perspective view illustrating the preferred bead in an open position.
Figure 4:
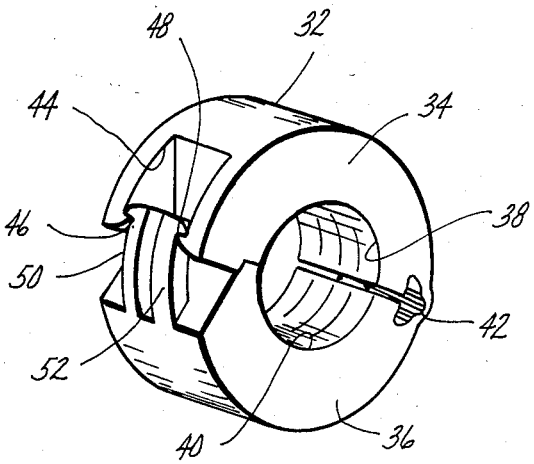
FIG. 4 illustrates a preferred bead with its two halves snapped together.

A typical bead 32 is illustrated in FIGS. 2, 3, and 4. Bead 32 is preferably formed of a pair of plastic semi-cylindrical halves 34 and 36 forming a body and a similar matching structure. Each half 34 has a semi-cylindrical opening 38 facing a similar semi-cylindrical opening 40 in half 36. When the two halves have joined with their ends in abutment, openings 38 and 40 cooperate to form an opening for wire section 26. Integral hinge means 42 connect one side of the two halves so that they are hingedly connected together for movement between an open position, illustrated in FIG. 3, and a closed position illustrated in FIG. 4. Half 34 has a latch-receiving cavity 44, and a pair of lips 46 and 48 defining a latch-receiving opening.

Half 36 has a pair of spaced, resilient arms 50 and 52 with a pair of ears 54 and 56. When the two bead halves are moved toward their closed position, ears 54 and 56 engage lips 46 and 48. Further movement of the two bead halves one toward the other causes arms 50 and 52 to move toward one another until the ears pass lips 46 and 48 and snap outwardly, trapped within cavity 44, latching the two halves together. The two bead halves can be opened by moving arms 50 and 52 toward one another until ears 54 and 56 pass between lips 46 and 48.

Thus it is to be understood that I have described a face mask bead which is mounted on the face mask frame after it has been welded together.

Having described my invention, I claim:

1. In combination with a football helmet having an opening for exposing the user's face, a mask including:

an elongated member spanning said opening;

means connecting opposite ends of the elongated member to opposite sides of the opening;

a plurality of beads mounted along the elongated member, each of said beads comprising;

a body having an opening for receiving the elongated member; and a structure mounted on the body for closing one side of said opening such that the body and the structure form a bead slideably rotatably mounted on the elongated member.

2. A combination as defined in claim 1, in which the body and said structure comprise a pair of similarly shaped halves, including means at opposite ends of the halves for connecting them together to form an opening.

3. A combination as defined in claim 1, in which each bead comprises a pair of halves each having a semi-cylindrical opening, and hinge means connecting one side of said halves together such that the two halves are hingedly connected together, and latch means at the opposite end of said halves adapted to snap said halves together in a closed position.

4. A combination as defined in claim 3, in which said latch means comprises one of said halves having an opening with a pair of inwardly projecting spaced lips and the opposite half has a pair of arms with a pair of outwardly projecting spaced ears, the arms being adapted to be received between the lips and up into the opening to a position in which the ears expand to a position larger than the space between the lips so as to retain the arms in a locked position.

5. The combination with a football helmet having an opening for exposing the user's face, a mask including:

a wire frame including a plurality of frame wire elements;

means mounting said frame on the helmet over the helmet opening;

a plurality of beads disposed side-by-side along at least one of the frame elements, each bead comprising;

a body having a central opening receiving the wire element so as to be rotatably mounted thereon, the body having means forming a lateral opening for removing the body from the wire element by passing the element from the central opening through the lateral opening.

6. A combination as defined in claim 5, in which each of the bodies is formed of a plurality of separable sections formed so as to be relatively movable with respect to one another to open or close said lateral opening.

* * * * *